US006547377B2

(12) United States Patent
Thielman et al.

(10) Patent No.: US 6,547,377 B2
(45) **Date of Patent: *Apr. 15, 2003**

(54) PRINTHEAD AIR MANAGEMENT USING UNSATURATED INK

(75) Inventors: Jeffrey L. Thielman, Corvallis, OR (US); Rhonda L. Wilson, Monmouth, OR (US); Mark A. DeVries, Albany, OR (US); Norman E. Pawlowski, Jr., Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/758,746

(22) Filed: Jan. 11, 2001

(65) Prior Publication Data

US 2001/0024223 A1 Sep. 27, 2001

Related U.S. Application Data

(63) Continuation-in-part of application No. 09/037,550, filed on Mar. 9, 1998, now Pat. No. 6,203,146.

(51) Int. Cl.[7] ..... B41J 2/175
(52) U.S. Cl. ..... 347/85
(58) Field of Search ..... 347/85, 86, 87, 347/92

(56) References Cited

U.S. PATENT DOCUMENTS 3,371,350 A 2/1968 Sanderson et al. ..... 346/140.1

(List continued on next page.)

FOREIGN PATENT DOCUMENTS

| | | | | |
|---|---|---|---|---|
| EP | 0287098 B1 | 10/1988 | ..... | B41J/3/04 |
| EP | 0562717 B2 | 9/1993 | ..... | B41J/2/175 |
| EP | 0745482 A2 | 5/1995 | ..... | B41J/2/175 |
| EP | 0770490 A2 | 10/1995 | ..... | B41J/2/19 |
| EP | 0714778 B1 | 6/1996 | ..... | B41J/2/17 |
| EP | 0927638 A | 7/1999 | | |
| EP | 0965451 A | 12/1999 | | |
| JP | 62-161544 | 7/1987 | | |
| JP | 07076094 | 6/1993 | ..... | B41J/2/175 |
| WO | WO/97/16315 | 5/1997 | ..... | B41J/2/175 |
| WO | WO/9908876 A | 2/1999 | | |

OTHER PUBLICATIONS

Patent Abstracts of Japan, vol. 014, No. 327 (M–03998), Jul. 13, 1990 & JP 02 111555 A (Fujitsu Ltd), Apr. 24, 1990.

European Search Report mailed Apr. 17, 2002, re EP Patent Application No. EP 0225 0179.

*Primary Examiner*—Michael Nghiem

(57) ABSTRACT

Techniques for air management in an inkjet printing systems. A method includes providing an ink supply for holding a supply of liquid ink, the ink supply including high barriers to air diffusion, filling the ink supply with a quantity of liquid unsaturated ink, storing the filled ink supply for a storage time interval or until needed, installing the ink supply in an inkjet printing system including an inkjet printhead, supplying unsaturated ink from the ink supply to the inkjet printhead for printing, and allowing the unsaturated ink to absorb air introduced into the printing system, and ejecting droplets of the liquid ink from the printing system during the printing. A semipermanent inkjet printhead for the inkjet printing system includes a printhead body with an internal plenum, a pressure regulator for regulating pressure in the plenum, a nozzle array for ejecting droplets of ink, a fluid inlet mounted to the printhead body and coupled to the plenum for connection to an ink supply path for ink delivered from a replaceable ink supply, and a supply of unsaturated ink disposed in the plenum, the unsaturated ink having an air solubility level sufficient to absorb air introduced into the printhead.

13 Claims, 10 Drawing Sheets

U.S. PATENT DOCUMENTS

| | | | | | |
|---|---|---|---|---|---|
| 4,509,062 | A | | 4/1985 | Low et al. | 347/87 |
| 4,558,326 | A | | 12/1985 | Kimura | 347/30 |
| 4,920,362 | A | | 4/1990 | Cowger | 347/87 |
| 4,992,802 | A | | 2/1991 | Dion et al. | 347/87 |
| 5,367,328 | A | | 11/1994 | Erickson | 347/7 |
| 5,369,429 | A | | 11/1994 | Erickson | 347/7 |
| 5,409,134 | A | | 4/1995 | Cowger et al. | |
| 5,488,400 | A | * | 1/1996 | Crystal et al. | 347/85 |
| 5,505,339 | A | | 4/1996 | Cowger et al. | 222/105 |
| 5,552,815 | A | | 9/1996 | Shimoda | 347/85 |
| 5,691,753 | A | * | 11/1997 | Hilton | 347/85 |
| 5,719,609 | A | | 2/1998 | Hauck et al. | 347/85 |
| 5,724,082 | A | | 3/1998 | Moynihan | 347/88 |
| 5,742,311 | A | | 4/1998 | Koitabashi et al. | 347/86 |
| 5,872,584 | A | * | 2/1999 | Hauck et al. | 347/86 |
| 5,900,890 | A | | 5/1999 | Mitchell | 347/28 |
| 5,975,689 | A | * | 11/1999 | Pawlowski et al. | 347/86 |
| 5,988,801 | A | | 11/1999 | Coiner | 347/85 |
| 6,017,118 | A | | 1/2000 | Gasvoda et al. | 347/86 |
| 6,068,370 | A | | 5/2000 | Miller et al. | 347/85 |
| 6,089,702 | A | * | 7/2000 | Hilton | 347/92 |
| 6,203,146 | B1 | | 3/2001 | Pawlowski, Jr. et al. | 347/85 |

* cited by examiner

FIG. 6
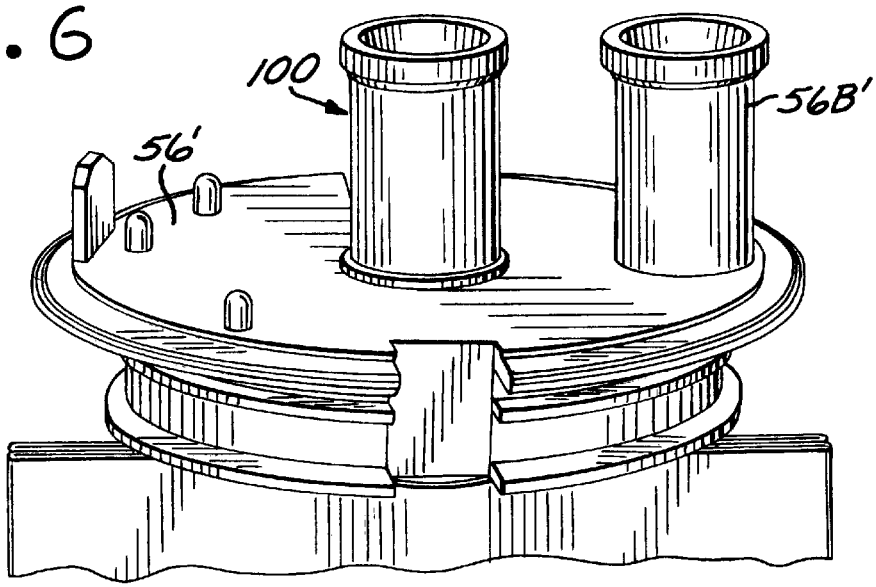
FIG. 7
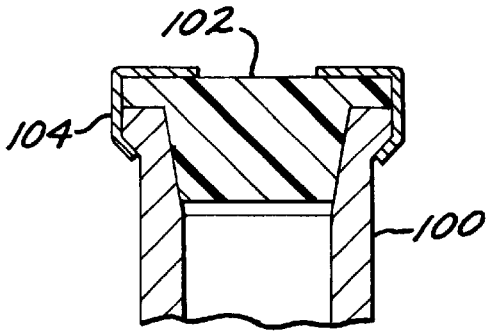
FIG. 8
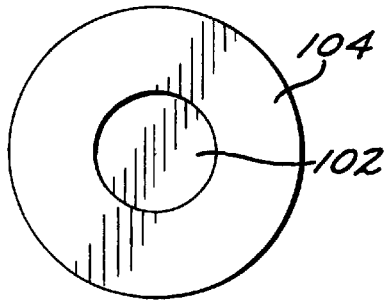
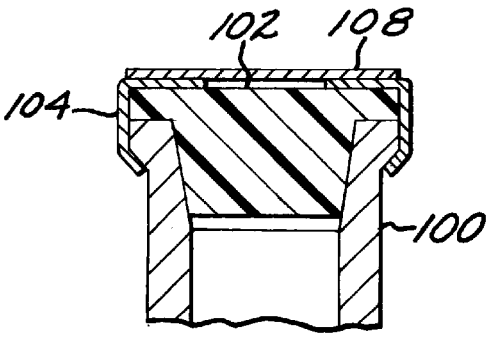
FIG. 9
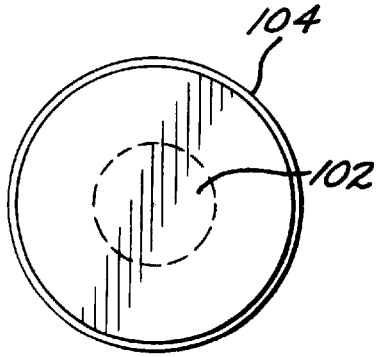
FIG. 10

PRINTHEAD AIR MANAGEMENT USING UNSATURATED INK

CROSS-REFERENCE TO RELATED APPLICATION

This application is a continuation-in-part of application Ser. No. 09/037,550, filed Mar. 9, 1998, now U.S. Pat. No. 6,203,146, PRINTING SYSTEM WITH AIR ACCUMULATION CONTROL MEANS ENABLING A SEMIPERMANENT PRINTHEAD WITHOUT AIR PURGE, the entire contents of which are incorporated herein by this reference.

This application is also related to application Ser. No. 09/758,744, filed Jan. 11, 2001,INK SUPPLY WITH AIR DIFFUSION BARRIER FOR UNSATURATED INK, the entire contents of which are incorporated herein by this reference.

TECHNICAL FIELD OF THE INVENTION

This invention relates to inkjet printing systems, and more particularly to techniques for managing air using unsaturated ink.

BACKGROUND OF THE INVENTION

Inkjet printing systems frequently make use of an inkjet printhead mounted to a carriage which is moved back and forth across a print media, such as paper. As the printhead is moved across the print media, control electronics activate an ejector portion of the printhead to eject, or jet, ink droplets from ejector nozzles and onto the print media to form images and characters. An ink supply provides ink replenishment for the printhead ejector portion.

Some printing systems make use of an ink supply that is replaceable separately from the printhead. When the ink supply is exhausted the ink supply is removed and replaced with a new ink supply. The printhead is then replaced at or near the end of printhead life and not when the ink supply is exhausted. When a replaceable printhead is capable of utilizing a plurality of ink supplies, this will be referred to as a "semipermanent" printhead. This is in contrast to a disposable printhead, that is replaced with each container of ink.

A significant issue with semipermanent printheads is premature failure due to loss of proper pressure regulation. To operate properly, many printheads have an operating pressure range that must be maintained in a narrow range of slightly negative gauge pressure, typically between −1 and −6 inches of water. Gauge pressure refers to a measured pressure relative to atmospheric pressure. Pressures referred to herein will all be gauge pressures. If the pressure becomes positive, printing and printing system storage will be adversely affected. During a printing operation, positive pressure can cause drooling and halt ejection of droplets. During storage, positive pressure can cause the printhead to drool. Ink that drools during storage can accumulate and coagulate on printheads and printer parts. This coagulated ink can permanently impair droplet ejection of the printhead and result in a need for costly printer repair. To avoid positive pressure, the printhead makes use of an internal mechanism to maintain negative pressure.

Air present in a printhead can interfere with the maintenance of negative pressure. When a printhead is initially filled with ink, air bubbles are often present. In addition, air accumulates during printhead life from a number of sources, including diffusion from outside atmosphere into the printhead and dissolved air coming out of the ink referred to as outgassing. During environmental changes, such as temperature increases or pressure drops, the air inside the printhead will expand in proportion to the total amount of air contained. This expansion is in opposition to the internal mechanism that maintains negative pressure. The internal mechanism within the printhead can compensate for these environmental changes over a limited range of environmental excursions. Outside of this range, the pressure in the printhead will become positive.

One solution to the air accumulation problem has been the use of disposable printheads. The amount of ink associated with a disposable printhead can be adjusted to keep air accumulation below a critical threshold. When the amount of ink is small, this increases the cost of printing by requiring frequent printhead replacement. Alternatively, the ink container can be made large to reduce frequency of printhead replacement. However, large ink containers become problematic when the printing application is a compact desktop printer. An example of a system utilizing a disposable printhead, wherein a large ink supply is replaced each time the printhead is replaced, is described in U.S. Pat. No. 5,369,429.

Another solution to the air accumulation problem has been the use of air purge mechanisms to make semipermanent printheads viable. An example of an air purge approach is described in U.S. Pat. No. 4,558,326. Issues with purging systems include the added printer cost for the purge mechanism, the reliability problems associated with accommodating the ink that tends to be purged out with air, and the stranding of air in the ink ejectors of the printhead, and increase in maintenance requirements.

Another solution to air management in inkjet printheads has been in the form of air warehousing. Air generated during the life of the pen is stored in the printhead. This requires the printhead to be able to compensate for expansion of the stored air due to thermal and pressure variations, which necessitates additional size and complexity. This additional size constrains the printer by placing more mass on the carriage and requiring a larger carriage for the printheads. As more printheads are added to the carriage, this issue becomes even more important.

It is known to use unsaturated ink in filling ink supplies. Insofar as is known, however, unsaturated ink has not heretofore been employed in addressing the problem of air accumulation in ink jet printheads.

SUMMARY OF THE INVENTION

Problems of air management in an inkjet printhead are addressed by preventing or minimizing the generation of air bubbles during the printing process, and providing techniques for reabsorption of air that does get introduced into the printing system.

In accordance with an aspect of the invention, a method of air management in an inkjet printing system is described. The method includes

- providing an ink supply for holding a supply of liquid ink, the ink supply including high barriers to air diffusion;
- filling the ink supply with a quantity of liquid unsaturated ink;
- storing the filled ink supply for a storage time interval or until needed;
- installing the ink supply in an inkjet printing system including an inkjet printhead;
- supplying unsaturated ink from the ink supply to the inkjet printhead for printing, and allowing the unsaturated ink to absorb air introduced into the printing system; and ejecting droplets of the liquid ink from the printing system during the printing.

In accordance with a further aspect of the invention, a semipermanent inkjet printhead is described, and includes a printhead body with an internal plenum, a pressure regulator for regulating pressure in the plenum, a nozzle array for ejecting droplets of ink, a fluid inlet mounted to the printhead body and coupled to the plenum for connection to an ink supply path for ink delivered from a replaceable ink supply, and a supply of unsaturated ink disposed in the plenum, the unsaturated ink having an air saturation level sufficient to absorb air introduced into the printhead.

The printhead can be used in a printing system, which includes a replaceable ink supply comprising an ink reservoir structure, a fluid interconnect fluidically coupled to the ink reservoir structure, and a body of unsaturated ink disposed in the ink reservoir structure, and an air diffusion barrier system protecting the body of unsaturated ink within the ink reservoir structure from air diffusion to provide a shelf life of at least a period of six months before the ink is saturated. The system includes an ink supply path coupled to the fluid interconnect of the ink supply and the fluid inlet of the printhead for carrying the unsaturated ink from the replaceable ink supply to the printhead.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 is an isometric view of the chassis of FIG. 3 with the insert installed, prior to attachment of the bag to the chassis.

FIG. 7 is a cross-sectional view taken through the tip of the insert after the septum and metal crimp can have been installed.

FIG. 8 is a top view of the structure shown in FIG. 7.

FIG. 9 is a view similar to FIG. 7, showing a metal layer affixed to the septum to provide an air diffusion barrier.

FIG. 10 is a top view of the structure of FIG. 9.

DETAILED DESCRIPTION OF THE PREFERRED EMBODIMENTS

In accordance with an aspect of the invention, an ink supply is described, wherein measures are taken to prevent the ingress of air into the ink supply from the external environment. Moreover, the ink container holds unsaturated ink, which provides the capability of absorbing some quantity of air within the printing system and therefore preventing or reducing the harmful buildup of air bubbles within the system.

Figure 1:
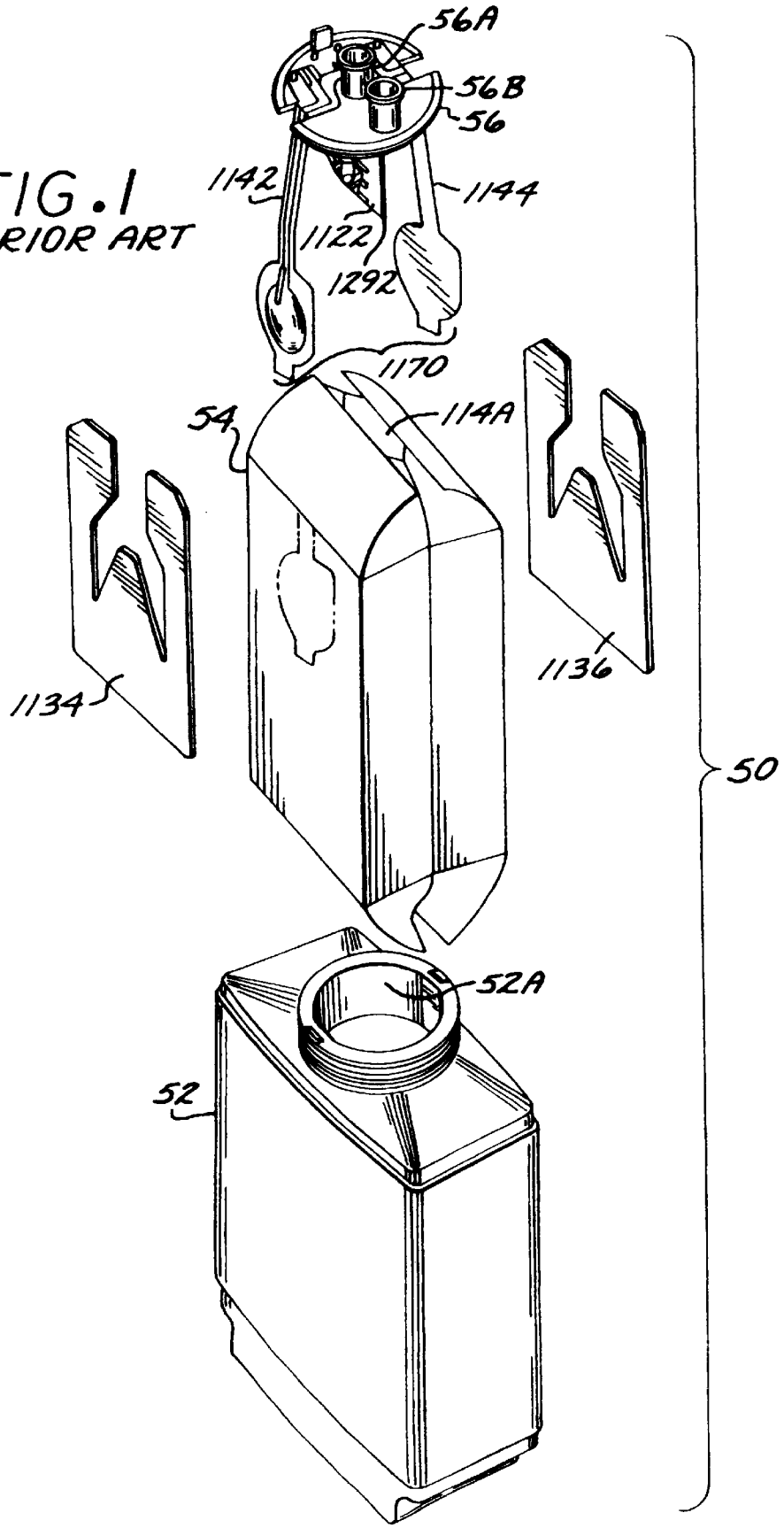
FIG. 1 PRIOR ART
FIG. 1 is an exploded isometric view of a pressurizable ink supply for an inkjet printing system.

This aspect of the invention is described with respect to the exemplary ink container described in U.S. Pat. No. 6,017,118, and generally illustrated in FIG. 1. For this example, the supply 50 is pressurized, and includes a pressure vessel 52 within which a collapsible bag 54 containing the ink is disposed. The bag 54 is attached to a chassis 56 which is mounted in the neck opening 52A of the bottle-like pressure vessel. The chassis 56 has separate ink and air towers 56A, 56B formed therein, with the ink tower containing a fluid path leading to the interior of the bag, and the air tower providing an air path to the pressurized region surrounding the bag within the pressure vessel. In an exemplary embodiment, the chassis member is a unitary element, fabricated of polyethylene by injection molding.

The collapsible bag is typically fabricated of multiple layers including a metalized or other layer providing very low air diffusion. In an exemplary embodiment, the collapsible bag can have the following construction of layers: LLDPE/LLDPE/Nylon//PET/Silver or Aluminum oxide or silicon oxide//Nylon, where "/" represents a coextruded or deposition bond of the layers, and "//" represents an adhesive bond. Other bag structures can also be used, e.g. linear low-density polyethylene (LLDPE)/LLDPE/LLDPE// polyamide (e.g. Nylon)//Al Foil or ethylene vinyl alcohol (EVOH) or Polyvinylidene Chloride copolymer (PVDC)// polyamide.

Figure 2:
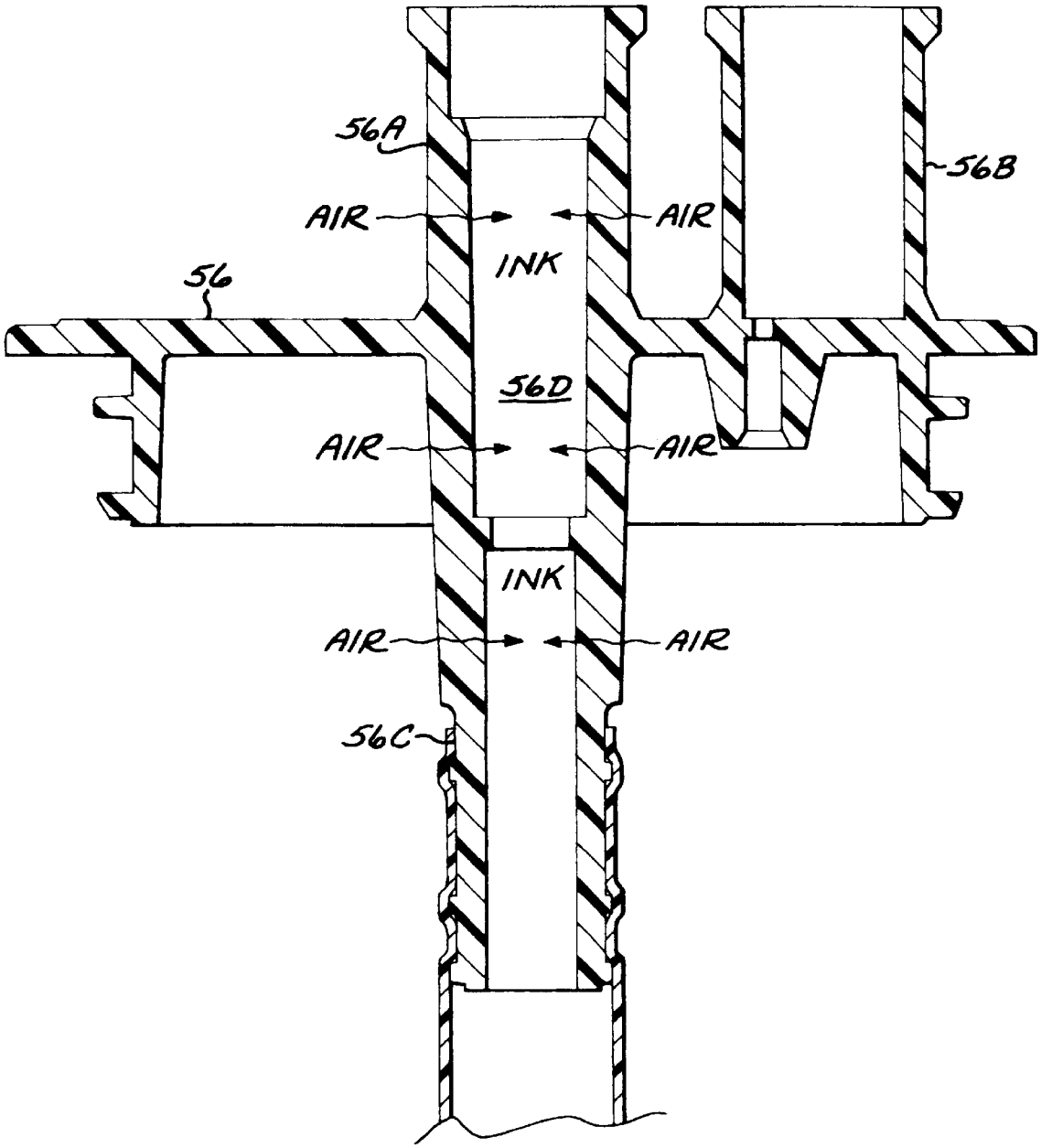
FIG. 2 PRIOR ART
FIG. 2 is a simplified cross-sectional diagram of the chassis member of the ink supply of FIG. 1.

This construction of the collapsible bag substantially prevents air diffusion through the bag and into the ink. It has been found, however, that the chassis member fabricated of a polyethylene such as LLDPE can provide an air diffusion path into ink stored in the ink container, i.e. through the chassis member into the ink. This air path is illustrated in FIG. 2, a simplified cross-sectional view of the chassis 56. The bag is attached to the chassis along a keel section 56C, and the air diffusion paths are generally above this attachment, through the LLDPE material defining the ink flow path 56D through the channel in the air flow tower.

Figure 3:
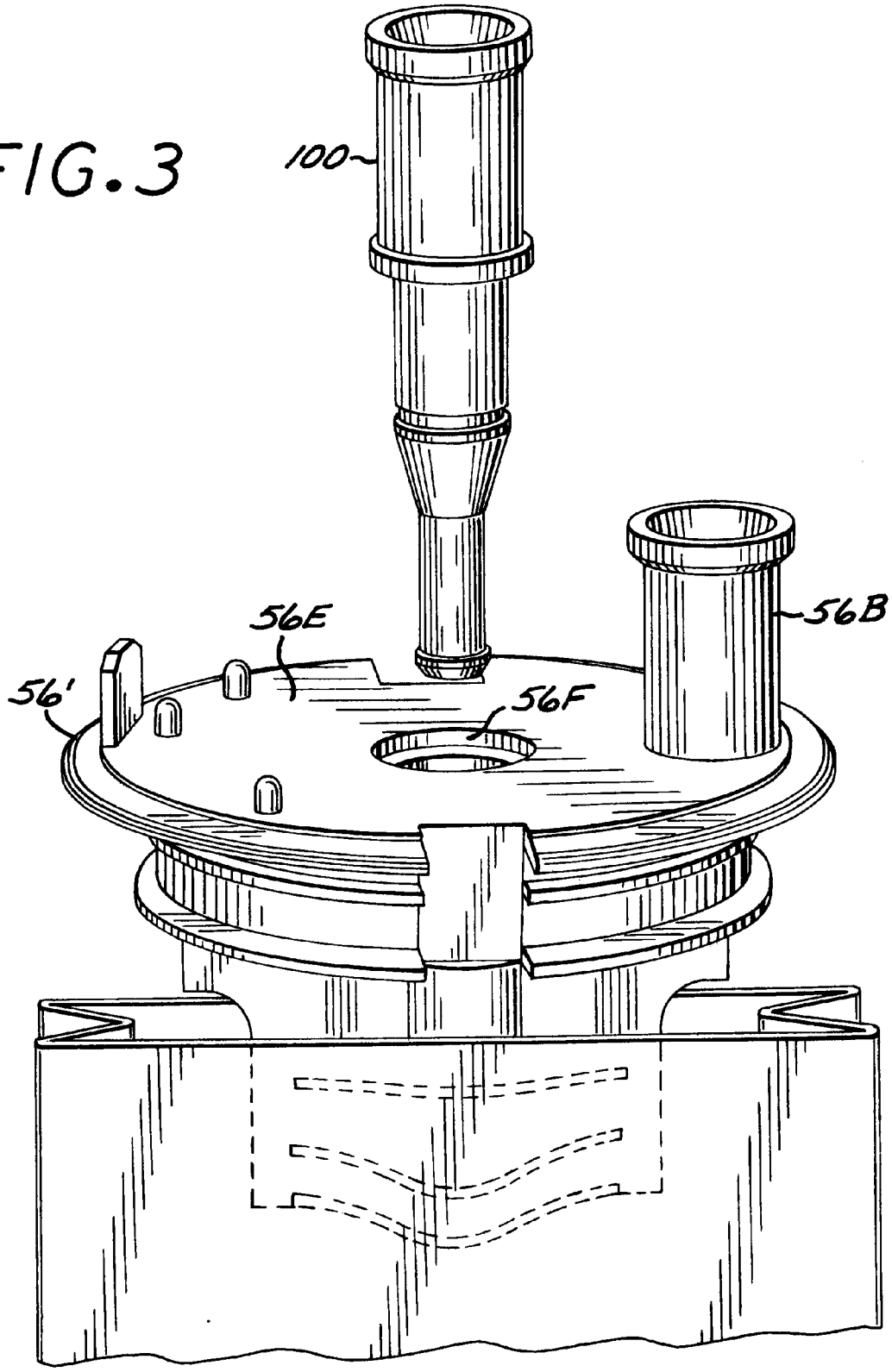
FIG. 3 is an exploded isometric view of a modified chassis with a metal insert in accordance with an aspect of the invention.

In accordance with an aspect of the invention, substantial improvements in the supply shelf life and quantity of delivered air to the printhead is achieved by improving the air barrier properties of the chassis. In an exemplary embodiment shown in FIG. 3, the air diffusion path through the chassis air tower material is closed by use of a metal insert 100 which is extended through the ink flow path of the chassis. The metal insert is fabricated of a material such as stainless steel, which is impermeable to air. In this embodiment, the chassis 56' is modified from the chassis 56 of FIGS. 1 and 2, in that the ink tower 56A protruding from the external surface 56E is eliminated, so that the chassis 56' has an opening 56F formed through the LLDPE material leading through the keel section of the chassis as in the embodiment of FIG. 1. The metal insert 100 is sized for a press fit into the opening 56F. Ultrasonic insertion, spin welding or heat could also be employed to improve the chassis-to-insert sealing and assembly force.

Figure 4:
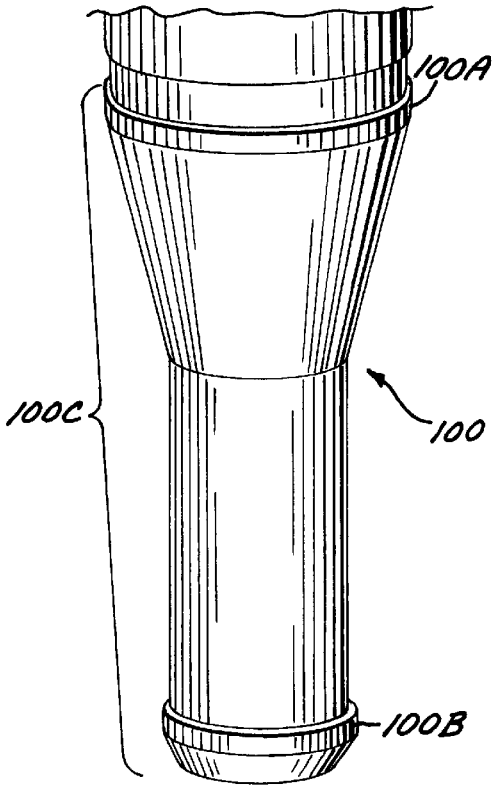
FIG. 4 illustrates the lower portion of the insert which is inserted into the chassis opening.

FIG. 4 illustrates the lower portion of the insert 100 which is inserted into the chassis opening. Circumferential areas 100A, 100B of the insert are enlarged relative to the inner diameter of the tapered chassis opening. Thus, the outer cross-sectional dimensions of the insert portion 100C are generally sized for fitting into the chassis opening, and areas 100A, 100B are slightly oversized relative to the chassis opening dimensions at the extremities of the insert portion 100C to provide an interference fit.

Figure 5:
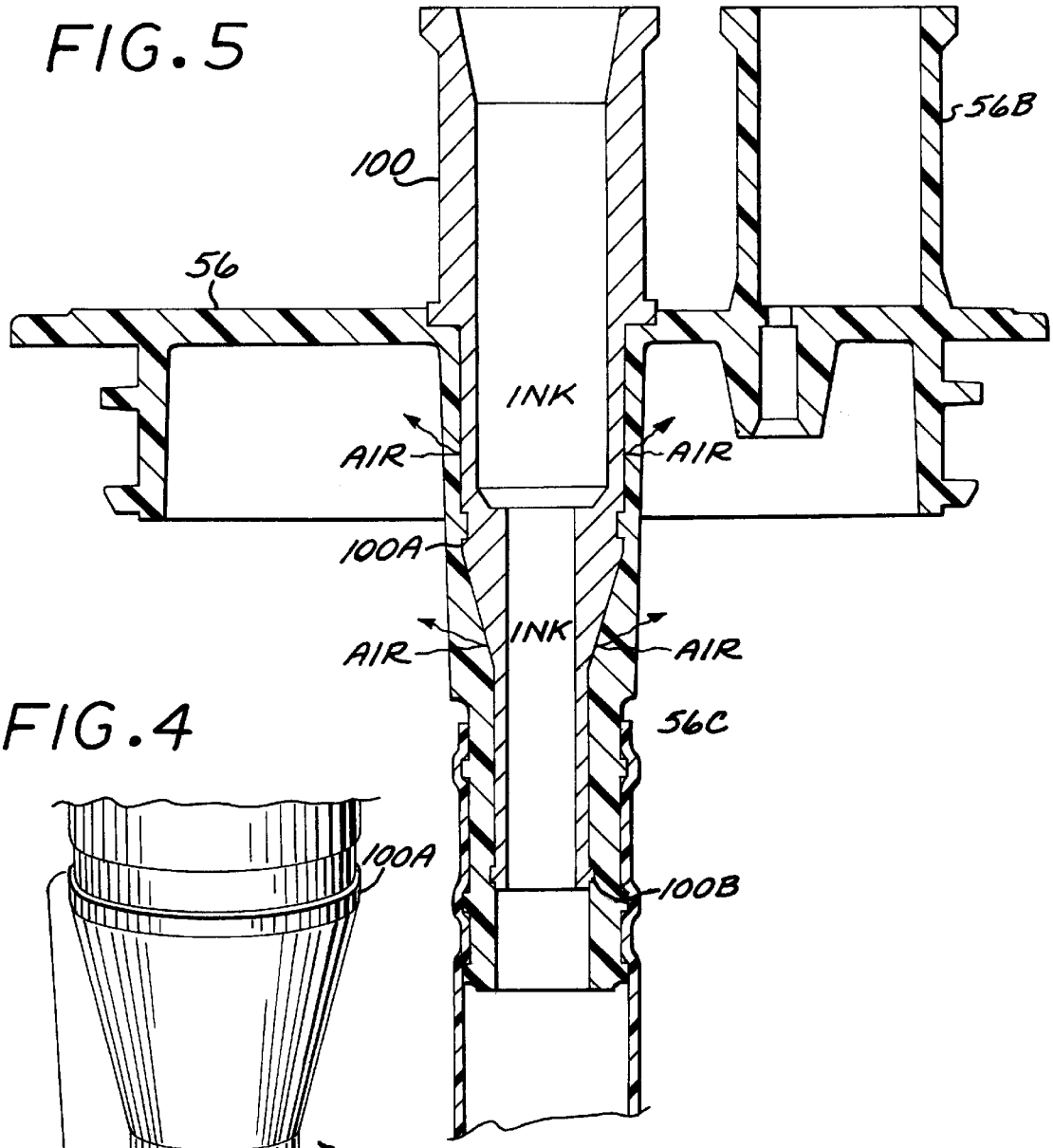
FIG. 5 is a simplified cross-sectional diagram showing the chassis of FIG. 3 with the insert in place.

FIG. 5 is a simplified cross-sectional diagram showing the chassis 56 with the insert 100 in place. Lower interference fit region 100B of the insert engages tightly with the adjacent areas of the chassis to define a primary seal area preventing the passage of ink, and area 100A provides a secondary seal area. The primary air diffusion paths are blocked by the insert.

FIG. 6 is an isometric view of the chassis 56' with the insert 100 installed, prior to attachment of the bag to the chassis.

Other chassis embodiments can alternatively be employed to provide improved air barrier performance. For example, the chassis insert 100 could alternatively be fabricated of stainless steel, ceramic or a higher barrier polymer, such as, by way of example only, polyamide, polyethylene teraphthalate (PET), acrylonitrile-butadiene-styrene (ABS), polyphenylene sulfide (PPS) or liquid crystal polymer (LCP). Another alternate embodiment is to fabricate the chassis 56 of a high air barrier material such as a polymer including polyamide, PET, ABS, PPS or LCP. To provide the ability to heat stake the collapsible bag to the chassis keel, an LLDPE piece can be either overmolded or pressed onto the chassis bottom portion to serve as a heat-stakable region to which the collapsible bag is attached.

Another source of air transmission into the ink supply 50 is through the septum and around the chassis/septum seal on the ink tower. FIG. 7 is a cross-sectional view taken through the tip of the insert 100 after the septum 102 and metal crimp can 104 have been installed. In the past, the septum has been fabricated of polyisoprene, which is a poor barrier to air diffusion, i.e. polyisoprene has a high air diffusion rate characteristic. The septum 102 is positioned at the top of the ink tower, provided in this case by the metal insert 100, and is held in place by the crimp can 104, fabricated of aluminum. FIG. 8 is a top view of the structure shown in FIG. 7, and shows that the crimp can 104 has a circular opening formed therein, exposing an area of the septum to the ambient atmosphere. When the ink supply is installed at the ink station of a printer, the ink station has a corresponding fitting including a hollow needle to penetrate the septum and allow ink to flow through the needle through a fluid conduit to a printhead. Prior to such installation, the exposed area of the septum provides an air diffusion path to diffuse into the ink supply through the ink flow path within the insert 100.

In accordance with a further aspect of the invention, the air diffusion path through the septum 102 is blocked by an air diffusion barrier structure, such as an adhesive-backed metal layer or tape 108, as illustrated in FIGS. 9 and 10. In an exemplary embodiment, the tape 108 comprises a thin layer of metal such as aluminum or copper, with a layer of adhesive applied to one side thereof. In an exemplary embodiment, the metal layer has a thickness of 0.003 inch, but thinner or thicker layers could also be used. In this embodiment, the tape 108 is placed over the septum 102 after the supply has been filled with ink through the septum. The tape is left in place during storage and use. When the ink supply is installed in the printer, the needle in the printer punctures the tape and penetrates the septum to allow ink to flow. Thus, the tape is not handled by the printer user.

In accordance with a further aspect of the invention, the septum 102 can be fabricated of a material which provides an excellent barrier to air diffusion, such as ethylene-propylene-diene monomer (EPDM), Butyl, an EPDM/polypropylene (PP) blend such as Santoprene, a Butyl/PP blend such as Trefsin, or other elastomers to improve the air barrier. Santoprene and Trefsin are products marketed by Advanced Elastomer Systems. In this case, for some applications, the tape 108 may be omitted, the septum providing the high air diffusion barrier. Of course, the metal tape 108 can included to provide additional margin against air diffusion.

Figure 12:
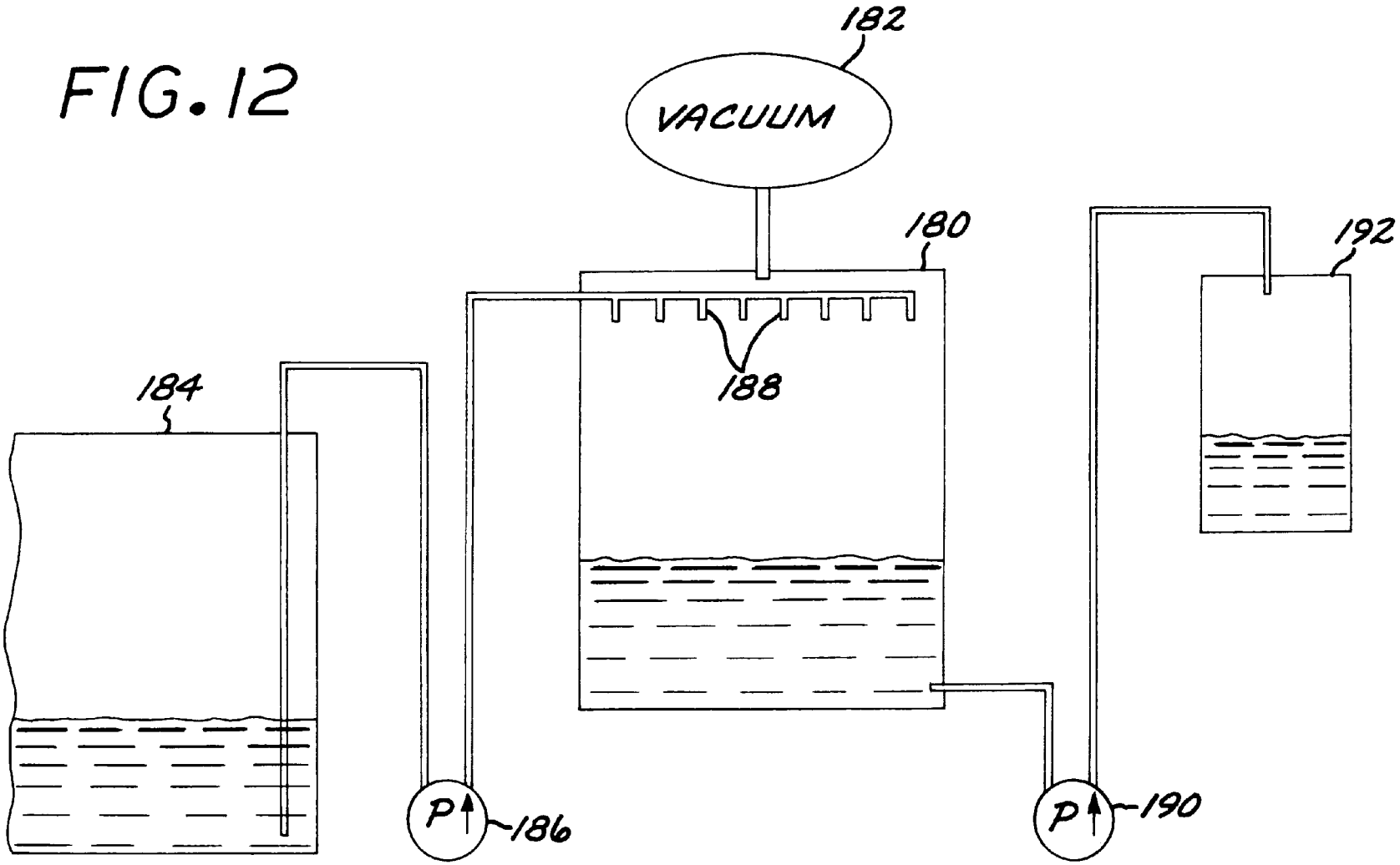
FIG. 12 is a diagrammatic view illustrating an exemplary process for degassing ink.

The above-described steps are taken to reduce the air diffusion paths into the ink supply, and thereby reduce the risk of air diffusion into the ink supply. In accordance with a further aspect of the invention, the ink used to fill the container is unsaturated. The saturation level of a liquid is dependent on its temperature, the ambient pressure and the liquid (ink) composition. In a preferred embodiment, the unsaturated ink is provided by a "degassing" technique in which the dissolved air has been removed from the ink. Techniques for degassing liquid inks are known in the art. FIG. 12 is a simplified diagrammatic illustration of a degassing process which can be employed to degas ink. A degas tank 180 is provided, and is connected to a source 182 of vacuum to pull the tank pressure to a fairly high vacuum. Ink to-be-processed is pumped from a supply container 184 by a pump 186 into the degas tank, through small needles 188 which spray the ink into the degas tank in a fine mist. When this mist is exposed to the vacuum within the degas tank, most of the air that is dissolved in the ink comes out from the ink, producing unsaturated or degassed ink. The unsaturated ink is then pumped by pump 190 from the degas tank into a degassed ink container 192, from which the ink is dispensed into the ink supplies 50. Other techniques can be employed to produce unsaturated ink, such as heating the ink, reducing the capacity of the ink to hold dissolved air and therefore causing the ink to release dissolved air. When the heated ink is cooled, it is unsaturated.

In an exemplary embodiment, the unsaturated ink dispensed into the ink supply 50 will have an air saturation level of no greater than 20%. As used herein, air saturation level is the percentage of dissolved (solubized) air in the liquid, compared to the maximum amount of air which can be dissolved in the liquid. Further, the ink supply 50 in accordance with a further aspect of the invention is protected against air diffusion into the ink such that the unsaturated ink held within the supply will have a useful shelf life prior to installation in a printing system of at least six months, and preferably at least eighteen months. Experimental work with an exemplary ink indicates that unsaturated ink with an air saturation level of 70% or less is necessary to resolubize significant amounts of air, for a particular ink and ink jet pen. This air saturation level needed to resolubize significant amounts of air will vary, depending on the ink characteristics and the printhead characteristics. This needed saturation level depends on printhead characteristics for several reasons. One is that the thermal characteristics of different printheads vary. If one printhead gets hotter than another type of printhead during operation, the efficiency of the hotter printhead will be less than the cooler printhead, and a lower saturation level will be needed. Also the volume of the ink within the printhead affects the saturation level, since the larger the volume, the longer the dwell time of ink near the air, and the more air can be absorbed. Thus, in accordance with another aspect of the invention, the ink delivered to the printhead has an air saturation level low enough to resolubize free air in the print cartridge on which the printhead is mounted. The ink within the ink supply should have not exceed this saturation level during the shelf life of the ink supply. In one exemplary embodiment, this air saturation level does not exceed 70%, and is preferably less, e.g. less than 50%.

With unsaturated ink filling the ink supply, and with the measures taken to substantially reduce the air diffusion rate into the ink supply, the ink supplied from the ink supply 50 after it is installed in a printer will be free of air bubbles and in an unsaturated stated, ideally free of dissolved air. By ensuring that the ink in the ink supply 50 remains degassed (unsaturated) over the life of the ink supply, air generation in the printer can be controlled. This is due to the capability of unsaturated ink to remove air in the printing system, i.e. by "regassing" or absorbing air bubbles as dissolved air. Thus, the invention includes preventing the generation of air bubbles during the printing process by providing barriers to air diffusion in the ink supply, and through the use of unsaturated ink providing a way to reabsorb any air that does get introduced into the printing system. An advantage of this technique is that it will contribute to the miniaturization of inkjet printhead architectures by reducing the volume needed to warehouse air and compensate for its expansion due to ambient thermal and pressure variations.

Figure 11:
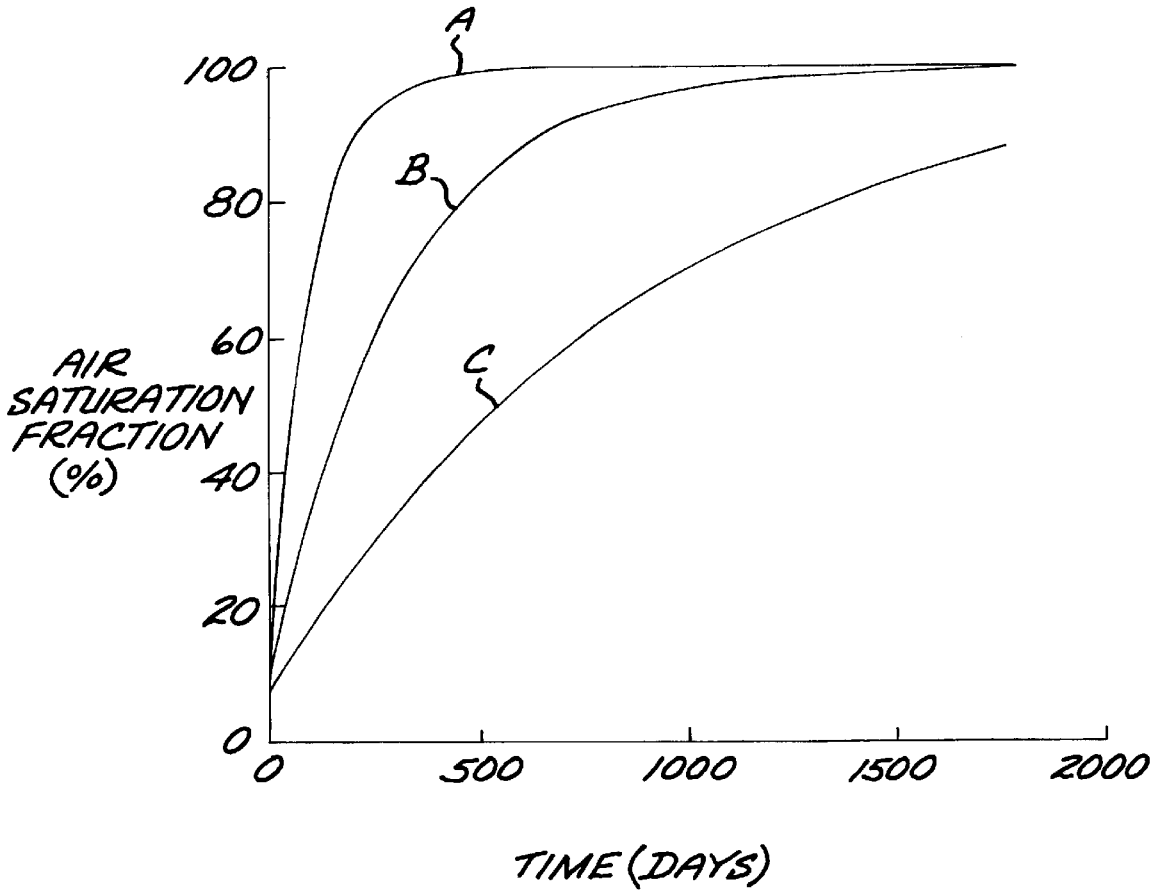
FIG. 11 is a graph depicting predicting ink resaturation rates for different ink supply features.

FIG. 11 is a graph indicated predicted ink resaturation rates for an ink supply for three different cases. The rate of resaturation is dependent on the volume of ink, and the ink supply whose resaturation rate is predicted in FIG. 11 is a large supply with at least 800 cc of a particular type of ink. Curve A indicates the predicted ink resaturation for a supply with a low density polyethylene chassis, a poor air diffusion barrier, and a reservoir bag including a polymer film of PVDC. Curve B indicates the predicted resaturation rate of a similar ink supply but with the reservoir bag including a metalized film as an air diffusion barrier. Curve C indicates a predicted resaturation rate for a similar ink supply to that of curve B, but with a metal fluid interconnect insert in the chassis. It can be seen that each of these air diffusion barrier measures affects the resaturation rates of the ink supply.

Ink is resaturated by air diffusion through the various materials used in the printing system and through absorption of free air from within the printhead. The air diffusion components is modeled by Fick's Law.

$$\partial V / \partial t = \frac{P \cdot A}{\text{thickness}} \cdot \Delta P$$

where V is the volume, t is time, A is diffusion area, thickness is the thickness of the diffusion area, Δp is the pressure difference (atmospheric air versus unsaturated ink), and P is the permeability of the material, which is a material specific property. A low P indicates a low diffusion rate, and a high P a high diffusion rate.

The air absorption capacity of a volume of ink can be determined using its air saturation level. For example, assume that the unsaturated ink has an air saturation level of 65%, so that it has a capacity to absorb an additional 35% before reaching the saturation level. If the ink holds 0.002 cc-air/cc-ink, then it could absorb 0.35*(0.002)=0.0007 cc-air/cc-ink.

As noted above, for one exemplary embodiment, the ink delivered to the printhead has an air saturation level of 70%, and preferably less. Once the ink supply 50 is installed in the printing system, the fluid interconnect between the ink supply 50 and the ink jet printhead or cartridge can allow air to enter the ink, and so the fluid interconnect should also provide a high barrier to air diffusion. Preferably, the tubes used for the fluid paths have a sufficiently low air diffusion property as to maintain ink held in the tubing in an unsaturated state for at least one day, and preferably for at least several days. This addresses the situation in which the printing system is not used overnight or for a weekend period, thus protecting the quantity of ink in the tubing.

Tubing useful for the fluid path and presenting a high barrier to air diffusion is described in U.S. Pat. No. 6,068,370. As described therein, the tubing can be fabricated of Polyvinylidene Chloride copolymer (PVDC), polychlorotrifluoroethylene (PCTFE) copolymer and ECTFE (ethylenechlorotrifluoroethylene). Other tubing suitable for the purpose is described in U.S. Pat. No. 5,988,801, HIGH PERFORMANCE TUBING FOR INKJET PRINTING SYSTEMS WITH OFF-BOARD INK SUPPLY.

Figure 13:
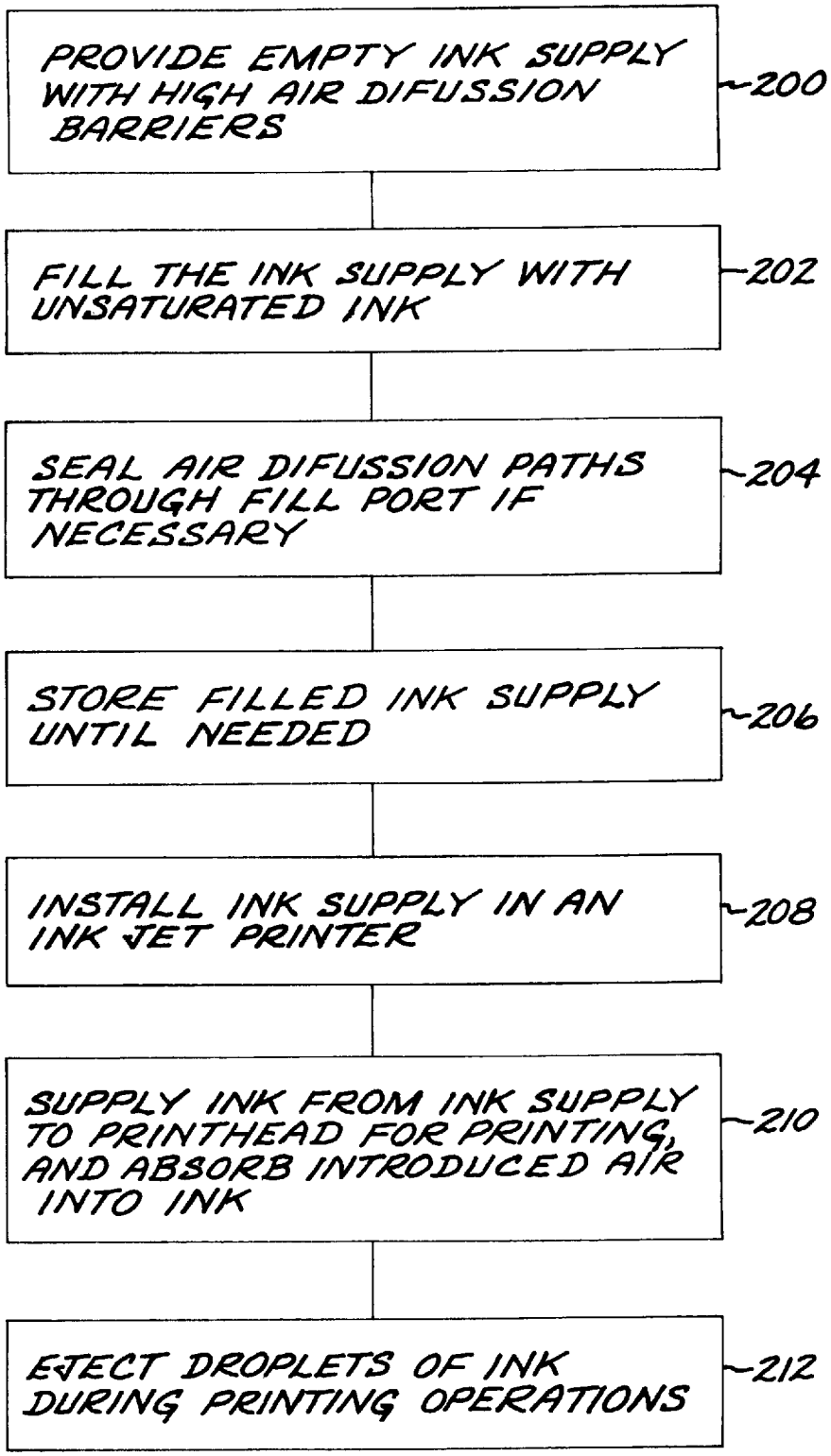
FIG. 13 is a flow diagram illustrating an exemplary method for managing air in an inkjet printing system with an ink supply in accordance with aspects of the invention.

FIG. 13 is a flow diagram illustrating an exemplary method for managing air in an inkjet printing system with an ink supply in accordance with aspects of the invention. At 200, an empty ink supply is provided with high air diffusion barriers. In an exemplary embodiment, the ink supply includes barriers such as the metallized bag for holding a supply of ink, and a metal insert lining the ink flow path from the bag outlet to the fluid interconnect for the ink supply.

At step 202, the ink supply is filled with unsaturated ink. This can be done, for the exemplary embodiment of FIGS. 3–8, by inserting a fill needle through the septum, with the needle coupled to a fill supply of unsaturated ink by a fluid conduit, and then releasing unsaturated ink through the fluid conduit and needle into the bag of the ink supply. Then, after filling the supply, the fill port into the bag is sealed by an air barrier such as metal tape positioned over the septum. Thereafter, the filled ink supply can be stored at 206 until needed or shipped and sold to a user. The ink supply is then installed in an ink jet printing system having an inkjet printhead at 208, and ink is supplied to the printhead from the ink supply for printing. The unsaturated ink supplied from the ink supply has the capability of absorbing air bubbles introduced into the system until the ink reaches a saturated condition.

Figure 14:
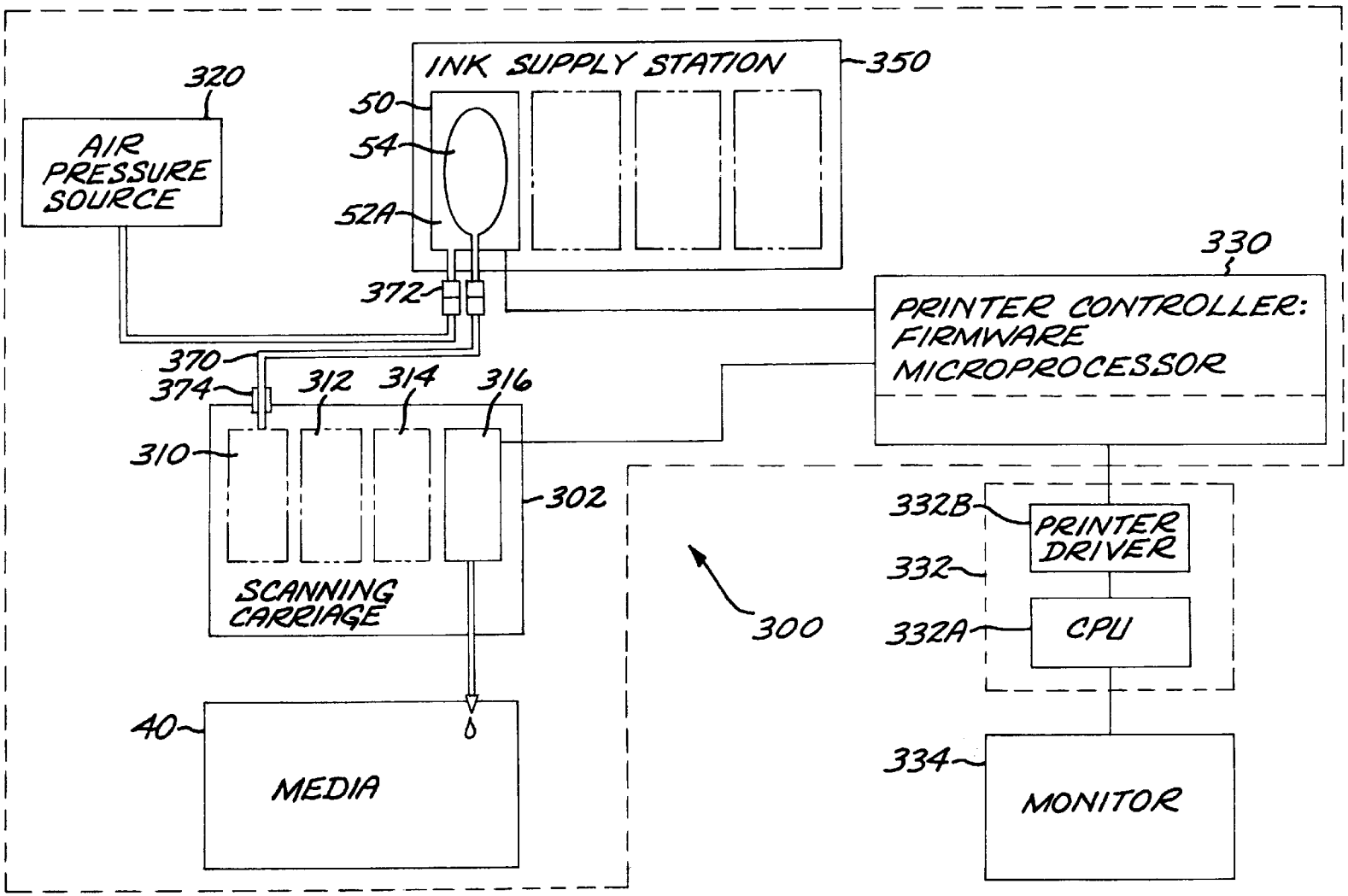
FIG. 14 is a schematic diagram of an ink jet printing system which can utilize the invention.

FIG. 14 shows an overall block diagram of a printer/plotter system 300 which embodies aspects of the invention. A scanning carriage 302 holds a plurality of high performance print cartridges 310–316 that are fluidically coupled to an ink supply station 400. The supply station provides pressurized ink to the ink jet print cartridges. Each cartridge has a regulator valve that opens and closes to maintain a slight negative gauge pressure in the cartridge that is optimal for printhead performance. The ink being received is pressurized to eliminate effects of dynamic pressure drops.

The ink supply station 350 contains receptacles or bays for slidable mounting a plurality of the ink containers 50. Each ink container has a collapsible ink reservoir 54 surrounded by an air pressure chamber 52A. An air pressure source or pump 320 is in communication with the air pressure chamber for pressurizing the collapsible reservoir. Pressurized ink is then delivered to the print cartridge, e.g. cartridge 310, by an ink flow path such as a tubing 370 and fluid interconnects 372 and 374 for respectively interconnecting ends of the tubing to the ink container 50 and the print cartridge 310. The tubing and fluid interconnects are preferably constructed to provide high barriers to air diffusion. The tubing can be constructed as described in U.S. Pat. No. 6,068,370 or U.S. Pat. No. 5,988,801. One air pump supplies pressurized air for all ink containers in this system. In an exemplary embodiment, the pump supplies a positive pressure of 2 psi, in order to meet ink flow rates on the order of 25 cc/min. Of course, for systems having lower ink flow rate requirement, a lower pressure will suffice, and some cases with low throughput rates will require no positive air pressure at all. For systems having higher ink flow rates, a higher pressure can be employed.

During idle periods, the region between the reservoir bag and the pressure vessel is allowed to de-pressurize. During shipping of the ink container 50, the supply is not pressurized.

The scanning carriage 302 and print cartridges 310–316 are controlled by the printer controller 330, which includes the printer firmware and microprocessor. The controller 330 thus controls the scanning carriage drive system and the print heads on the print cartridge to selectively energize the print heads, to cause ink droplets to be ejected in a controlled fashion onto the print medium 40.

The system 300 typically receives printing jobs and commands from a computer work station or personal computer 332, which includes a CPU 322A and a printer driver 322B for interfacing to the printing system 300. The work station further includes a monitor 334.

Figure 15:
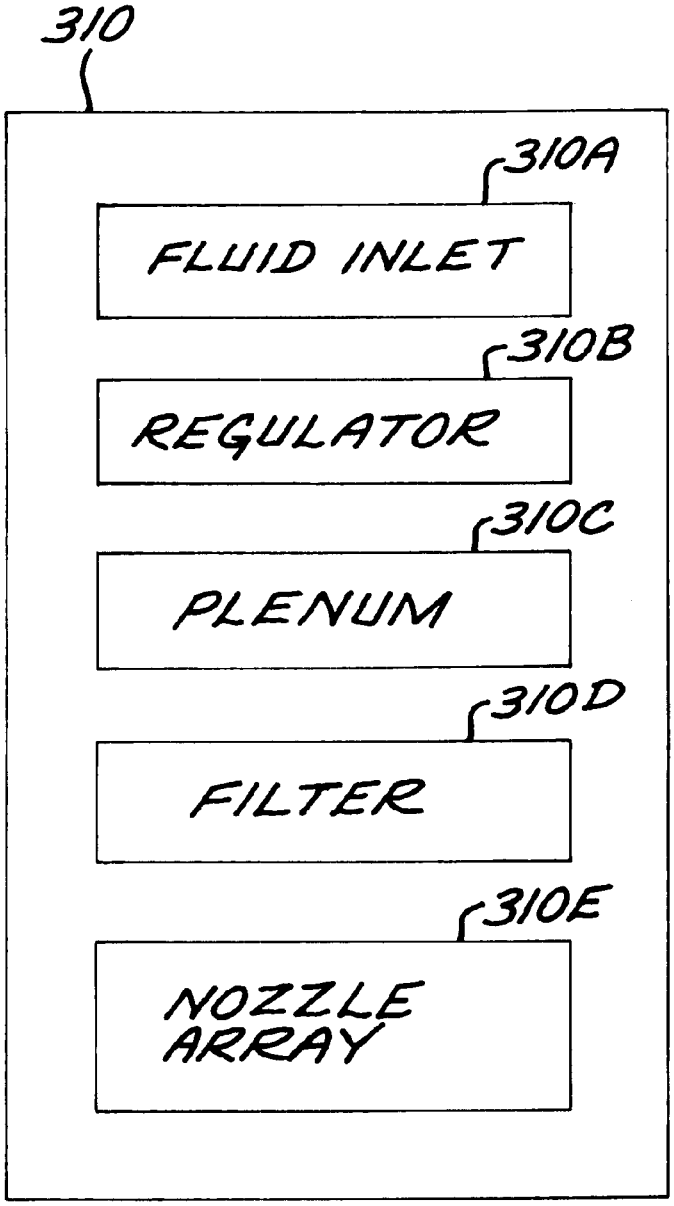
FIG. 15 is a schematic representation of an exemplary printhead used in the inkjet printing system of FIG. 14 in accordance with an aspect of the invention.

FIG. 15 is a schematic representation of an exemplary printhead 310 used in the inkjet printing system. The printhead 310 is a semipermanent printhead, since it can utilize the ink supplied from a plurality of the replaceable ink supplies 50. This allows the printhead to be of compact size, thus allowing reduction in the size of the printing system. The printhead 310 includes a fluid interconnect 310A for connecting to a fluid conduit such as tubing 370 (FIG. 14), at an incoming pressure and then delivers the ink to nozzle array 310E at a controlled internal pressure that is lower than the incoming pressure. The nozzle array is fluidically coupled to a plenum 310C that stores a quantity of ink at the controlled internal pressure. Ink passes through a filter 310D before reaching the nozzle array to remove particulates and air bubbles. The negative pressure in the plenum 310C is controlled by a regulator 310B, which can include a valve and an actuator in an exemplary embodiment. As the nozzle array deposits ink on media, the ink in the plenum is depleted, decreasing the internal pressure in the plenum. When the internal pressure reaches a low pressure threshold, the regulator responds by allowing ink to pass from the fluid conduit into the plenum. This introduction of ink raises the pressure of the plenum. When the internal pressure reaches a high pressure threshold, the regulator closes the valve. Thus the regulator regulates the pressure in the plenum between the low pressure and the high pressure thresholds.

The printhead structure described in the above referenced application Ser. No. 09/037,550, now U.S. Pat. No. 6,203,146 can be employed in the printhead 310. Alternatively, the printhead 310 can be a printhead of the type illustrated in pending application Ser. No. 09/748,059, now allowed filed Dec. 22, 2000, APPARATUS FOR PROVIDING INK TO AN INK JET PRINT HEAD, attorney docket number 10992132, the entire contents of which are incorporated herein by this reference.

The plenum 310C has a warehouse capacity for storing a warehouse volume of air before the pressure regulation function of the regulator is rendered ineffective. Once the regulator fails, the pressure within the printhead rises, allowing ink drool from the nozzle array. Printheads can be employed with varying warehouse capacities, including for example 30 cc of air, 10 cc of air, 4.5 cc of air. These capacities allow regulator operation even while this amount of air has been introduced into the plenum. These warehouse capacities are a factor in the useful life of the semipermanent printhead 310. As a result of the measures described above with respect to the use of unsaturated ink and the air diffusion barriers in the ink supply 50 and the fluid conduit, the size of the printhead can be reduced, for a given nominal printhead life, to reduce the warehouse capacity of the printhead, thus allowing further miniaturization of the printhead. In one exemplary embodiment, the warehouse capacity of the plenum 310C is less than 4.5 cc of air.

It is understood that the above-described embodiments are merely illustrative of the possible specific embodiments which may represent principles of the present invention. Other arrangements may readily be devised in accordance with these principles by those skilled in the art without departing from the scope and spirit of the invention. For example, while the exemplary ink supply is a pressurized supply, the advantages of the invention are also applicable to non-pressurized ink supplies.

What is claimed is:

1. An inkjet printing system, comprising:

a replaceable ink supply comprising an ink reservoir structure, a fluid interconnect fluidically coupled to the ink reservoir structure, a body of unsaturated ink disposed in said ink reservoir structure, the fluid interconnect providing a fluid path for the ink to pass from the reservoir structure, and an air diffusion barrier system protecting the body of unsaturated ink within the ink reservoir structure from air diffusion to provide a shelf life of at least a period of six months before the ink is saturated;

a semipermanent inkjet printhead, comprising a printhead body with an internal plenum, a nozzle array for ejecting droplets of ink, and a fluid inlet mounted to the printhead body and coupled to the plenum, wherein said printhead is free of any air purging apparatus for directly purging air from the printhead to the external environment; and an ink supply path coupled to the fluid interconnect of the ink supply and the fluid inlet of the printhead for carrying said unsaturated ink from the replaceable ink supply to the printhead.

2. The system of claim 1, wherein the unsaturated ink in the replaceable ink supply has an air saturation level of 70% or less.

3. The system of claim 1, wherein the ink supply path comprises a fluid conduit providing a high barrier to air diffusion into the conduit from the external environment.

4. The system of claim 1 wherein the ink delivered to the printhead has an air saturation level of 70% or less.

5. The system of claim 1 wherein the ink delivered to the printhead has an air saturation level of 50% or less.

6. The system of claim 1 wherein printhead includes a pressure regulator for regulating pressure in said plenum, and said plenum provides a warehouse capacity for holding a warehouse volume of air, while allowing the regulator to maintain said pressure within an operating range.

7. The system of claim 6 wherein said warehouse capacity is 30 cc of air or less.

8. The system of claim 6 wherein said warehouse capacity is 10 cc of air or less.

9. The system of claim 6 wherein said warehouse capacity is 4.5 cc of air or less.

10. A method of air management in an inkjet printing system, comprising:

filling an ink supply including high barriers to air diffusion with a quantity of liquid unsaturated ink through an ink supply interconnect port;

attaching a high air diffusion barrier to the interconnect port after said filling step to prevent air diffusion through the port during storage;

storing the filled ink supply for a storage time interval or until needed;

installing the ink supply in an inkjet printing system including an inkjet printhead;

supplying unsaturated ink from the ink supply to the inkjet printhead for printing, the unsaturated ink supplied to the printhead having an air solubility level sufficient to absorb air;

removing air introduced into the printhead, including allowing the unsaturated ink to absorb air introduced into the printing system; and ejecting droplets of the liquid ink from the printing system during the printing.

11. A method of air management in an inkjet printing system, comprising:

providing an ink supply for holding a supply of liquid ink, the ink supply including a reservoir, a fluid interconnect for interconnecting to the printing system when the ink supply is installed in the printing system, and an ink flow path between the reservoir and the fluid interconnect;

installing a barrier structure in the ink supply for shielding the ink flow path from air diffusion from the external environment into the ink flow path;

filling the ink supply with a quantity of liquid unsaturated ink;

storing the filled ink supply for a storage time interval or until needed;

installing the ink supply in an inkjet printing system including an inkjet printhead;

supplying unsaturated ink from the ink supply to the inkjet printhead for printing, the unsaturated ink supplied to the printhead having an air solubility level sufficient to absorb air;

removing air introduced into the printhead, including allowing the unsaturated ink to absorb air introduced into the printing system; and ejecting droplets of the liquid ink from the printing system during the printing.

12. The method of claim 11 wherein the step of installing a first barrier structure includes inserting a metal barrier insert structure into the ink flow path.

13. A method of air management in an inkjet printing system, comprising:

providing an ink supply for holding a supply of liquid ink, the ink supply including high barriers to air diffusion;

filling the ink supply with a quantity of liquid unsaturated ink;

storing the filled ink supply for a storage time interval or until needed;

installing the ink supply in an inkjet printing system including an inkjet printhead;

supplying unsaturated ink from the ink supply to the inkjet printhead for printing, the unsaturated ink supplied to the printhead having an air solubility level sufficient to absorb air;

removing air introduced into the printhead without purging air directly from the reservoir to the ambient environment, including allowing the unsaturated ink to absorb air introduced into the printing system; and ejecting droplets of the liquid ink from the printing system during the printing.

* * * * *

UNITED STATES PATENT AND TRADEMARK OFFICE

CERTIFICATE OF CORRECTION

PATENT NO. : 6,547,377 B2
DATED : April 15, 2003
INVENTOR(S) : Thielman et al.

It is certified that error appears in the above-identified patent and that said Letters Patent is hereby corrected as shown below:

Column 10,
Line 67, after "port" insert -- to provide a shelf life of at least a period of six months before ink is saturated --;

Column 11,
Line 28, after "path" insert -- to provide a shelf life of at least a period of six months before ink is saturated --;

Column 12,
Line 17, after "diffusion" insert -- to provide a shelf life of at least a period of six months before ink is saturated --.

Signed and Sealed this

Twenty-third Day of March, 2004

JON W. DUDAS
*Acting Director of the United States Patent and Trademark Office*